US006912368B2

(12) United States Patent
Nagashima

(10) Patent No.: US 6,912,368 B2
(45) Date of Patent: Jun. 28, 2005

(54) ROTARY BODY SUPPORT STRUCTURE AND IMAGE FORMING APPARATUS USING THE SAME

(75) Inventor: Hiroyuki Nagashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/603,808

(22) Filed: Jun. 26, 2003

(65) Prior Publication Data

US 2004/0047650 A1 Mar. 11, 2004

(30) Foreign Application Priority Data

Jun. 28, 2002 (JP) ..... 2002-189482

(51) Int. Cl.[7] ..... G03G 21/16; G03G 15/00
(52) U.S. Cl. ..... 399/111; 399/117
(58) Field of Search ..... 399/26, 107, 111, 399/116, 117, 159

(56) References Cited

U.S. PATENT DOCUMENTS 5,287,158 A 2/1994 Nagashima et al.
5,457,520 A * 10/1995 Schell et al. ..... 399/117
5,640,650 A * 6/1997 Watanabe et al. ..... 399/117
5,745,825 A * 4/1998 Okawa et al. ..... 399/117
5,845,173 A * 12/1998 Zogg et al. ..... 399/117 X
5,999,772 A 12/1999 Kakitani et al.
6,249,661 B1 * 6/2001 Saitoh et al. ..... 399/117
6,337,957 B1 1/2002 Tamaki et al.
6,507,718 B2 1/2003 Ohjimi et al.
6,522,855 B1 2/2003 Katoh et al.
6,549,738 B2 * 4/2003 Otani et al. ..... 399/117
6,553,202 B2 4/2003 Tamaki et al.
6,615,722 B2 * 9/2003 Alberstadt et al. ..... 399/116 X

* cited by examiner

*Primary Examiner*—Sandra L. Brase
(74) *Attorney, Agent, or Firm*—Oblon, Spivak, McClelland, Maier & Neustadt, P.C.

(57) ABSTRACT

In a structure for rotatably supporting a rotary body including a rotary shaft of the present invention, the rotary shaft is assembled integrally with or rigidly affixed to end plates, which are fitted in axially opposite ends of the rotary body, beforehand. The rotary body is therefore rotatable relative to or integrally with the rotary shaft.

11 Claims, 4 Drawing Sheets

ROTARY BODY SUPPORT STRUCTURE AND IMAGE FORMING APPARATUS USING THE SAME

BACKGROUND OF THE INVENTION

1. Field of the Invention

The present invention relates to a rotary body support structure and an image forming apparatus using the same. More particularly, the present invention relates to a structure for positioning a photoconductive drum or image carrier or similar drum included in an image forming apparatus.

2. Description of the Background Art

Generally, a copier, printer, facsimile apparatus or similar image forming apparatus includes a plurality of drums for image formation, e.g., a photoconductive drum or image carrier and a drum included in an image transferring unit. A drum or similar rotary body is usually rotatably mounted on a shaft, i.e., freely rotatable relative to the shaft. Particularly, to facilitate machining and assembly, it is a common practice to prepare a shaft and a rotary body separate from each other and then insert the shaft into the rotary body to allow the latter to freely rotate on the former.

The shaft is, in many cases, mounted to the rotary body after its axis has been positioned, because the shaft determines the axis of the rotary body. Japanese Patent Laid-Open Publication No. 2001-208044, for example, discloses the following assembling procedure. One of end plates mounted on axially opposite ends of a photoconductive drum or rotary body is formed with slots, each being triangular as seen in a front view, at opposite sides of the center. A rotation transmitting member is formed with tapered surfaces capable of mating with the above slots on one of axially opposite sides and formed with a tapered, concave, conical surface on the other side. The rotation transmitting member is mounted to a rotary shaft, which is inserted in the drum, such that the tapered surfaces bite into the slots of the end plate. A knob member is mounted to the shaft with its boss mating with the tapered conical surface and is moved in the axial direction to position the drum in the axial direction. At the same time, the tapered portions mate with each other to match the axis of the drum and that of the rotation transmitting member. Further, when the knob member is mounted to a stationary portion included in an apparatus body, the drum is positioned inside the apparatus body because the knob member has been positioned relative to the axis of the drum.

While the procedure described above matches the axes of the members formed with tapered surfaces by causing the tapered surfaces to mate with each other, the procedure has the following problem left unsolved.

Today, there is an increasing demand for full-color or similar multicolor images as distinguished from single-color images. In this respect, accurately positioning a plurality of photoconductive drums relative to each other is essential for superposing images of different colors in accurate register. The drums, each being assigned to a particular color, each are sometimes mounted on a respective process cartridge or image forming unit together with various process units including a charger, a developing unit and a cleaning unit. In this case, a particular rotary shaft is inserted in each drum cartridge by cartridge.

Although a multicolor image forming apparatus tends to increase in size in accordance with the number of colors, size reduction is a prerequisite. For size reduction, the individual process cartridge and a space available in the apparatus are decreasing. To meet such a demand as to configuration, after the drum has been temporarily positioned, the rotary shaft is inserted into the drum. However, a space available for inserting the rotary shaft is extremely limited. Moreover, a space inside a small-size apparatus does not have a sufficient margin in the axial direction that is necessary for the drum of the document mentioned earlier, among the others, to be prevented from moving in the axial direction, i.e., in the direction of thrust. This is also true when maintenance or replacement must be performed by hand, resulting in extremely inefficient work.

SUMMARY OF THE INVENTION

It is an object of the present invention to provide a rotary body support structure capable of saving a space for assembly and simplifying assembly and an image forming apparatus using the same.

In accordance with the present invention, in a structure for rotatably supporting a rotary body including a rotary shaft, the rotary shaft is assembled integrally with or rigidly affixed to end plates, which are fitted in axially opposite ends of the rotary body, beforehand. The rotary body is therefore rotatable relative to or integrally with the rotary shaft.

An image forming apparatus using the above structure is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
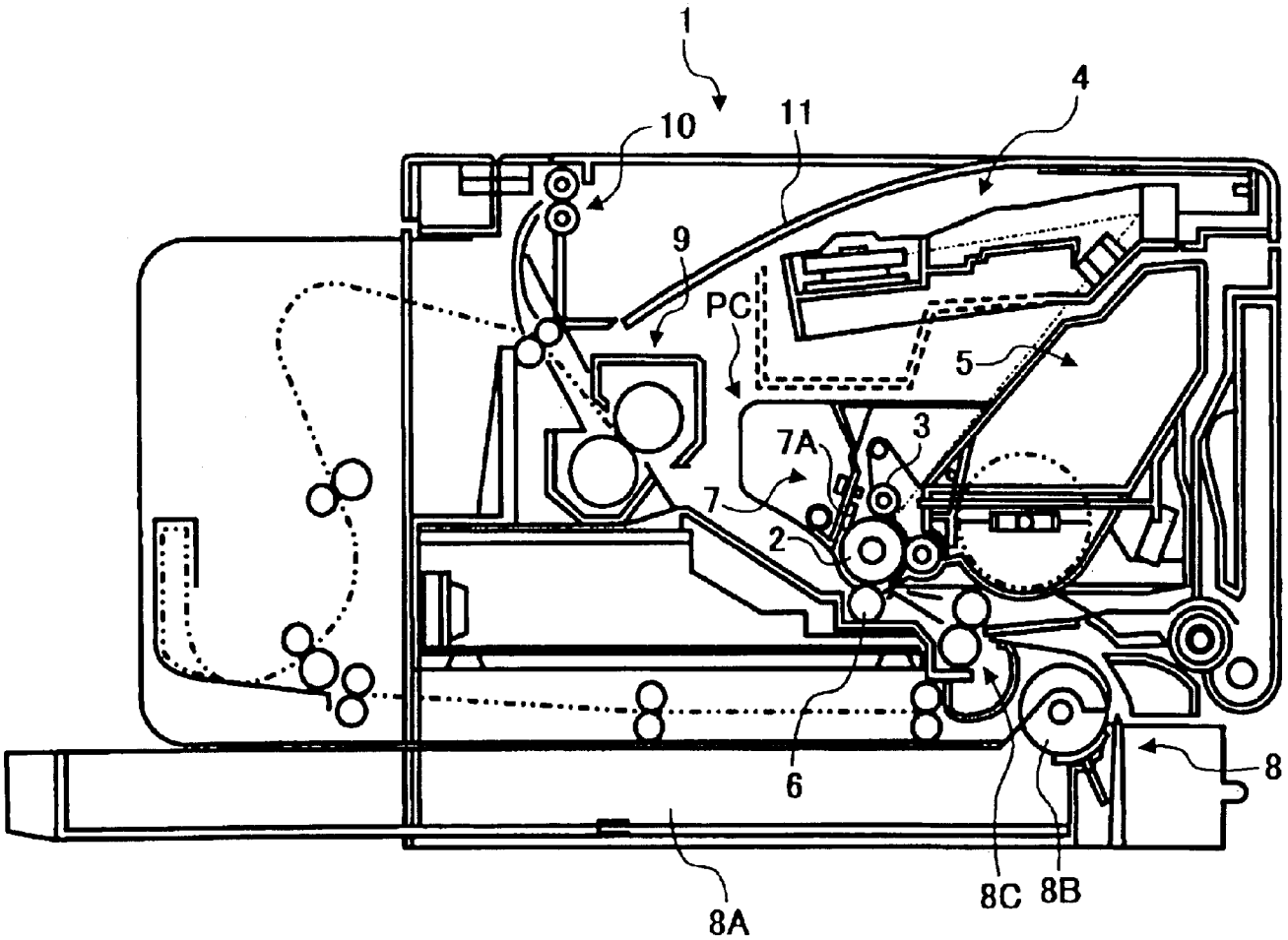
FIG. 1 shows an image forming apparatus to which the present invention is applied.

Referring to FIG. 1 of the drawings, an image forming apparatus to which the present invention is applied is shown. While the image forming apparatus to be described is implemented as a laser printer configured to write an image with a laser beam in accordance with image data, it may, of course, be implemented as, e.g., a copier, a facsimile apparatus or a printer. As shown, the laser printer, generally 1, includes a photoconductive drum 2, which is a specific form of an image carrier. Arranged around the drum 2 are a charger 3, an optical writing unit 4, a developing unit 5, an image transferring unit 6, and a cleaning unit 7.

The charger 3 uses a roller or contact type charging member. The developing unit 5 includes a sleeve 5A facing the drum 2. The image transferring device 6 is implemented as a rotatable roller facing the drum 2. The cleaning unit 7 includes a non-rotatable cleaning blade 7A capable of contacting the drum 2 and a discharging member.

In operation, the charger 3 uniformly charges the surface of the drum 2 being rotated. The writing unit 4 scans the surface of the drum 2 thus charged with a laser beam in accordance with image data to thereby form a latent image on the drum 2. The developing unit 5 develops the latent image with a developer deposited on the sleeve 5A for thereby forming a corresponding toner image. When a sheet or recording medium is conveyed from a sheet feeding device 8 to the image transferring unit 6, the image transferring unit 6 transfers the toner image from the drum 2 to the sheet. More specifically, the sheet is paid out from a cassette 8A by a pickup roller 8B, stopped by a registration roller pair 8C, and then driven by the registration roller pair 8C toward a nip between the drum 2 and the image transferring unit 6 at preselected timing.

Subsequently, a fixing unit 9 fixes the toner image formed on the sheet with heat and pressure. The sheet or print coming out of the fixing unit 9 is driven out to a tray 11 by an outlet roller pair 10.

After the image transfer, the cleaning unit 7 removes toner left on the drum 2 and then discharges the drum 2, thereby preparing the drum 2 for the next image forming cycle.

In the laser printer 1, the drum or rotary body 2, charger 3, developing unit 5 and cleaning unit 7, including the non-rotatable cleaning blade 7A, are mounted on a process cartridge PC together.

Figure 2:
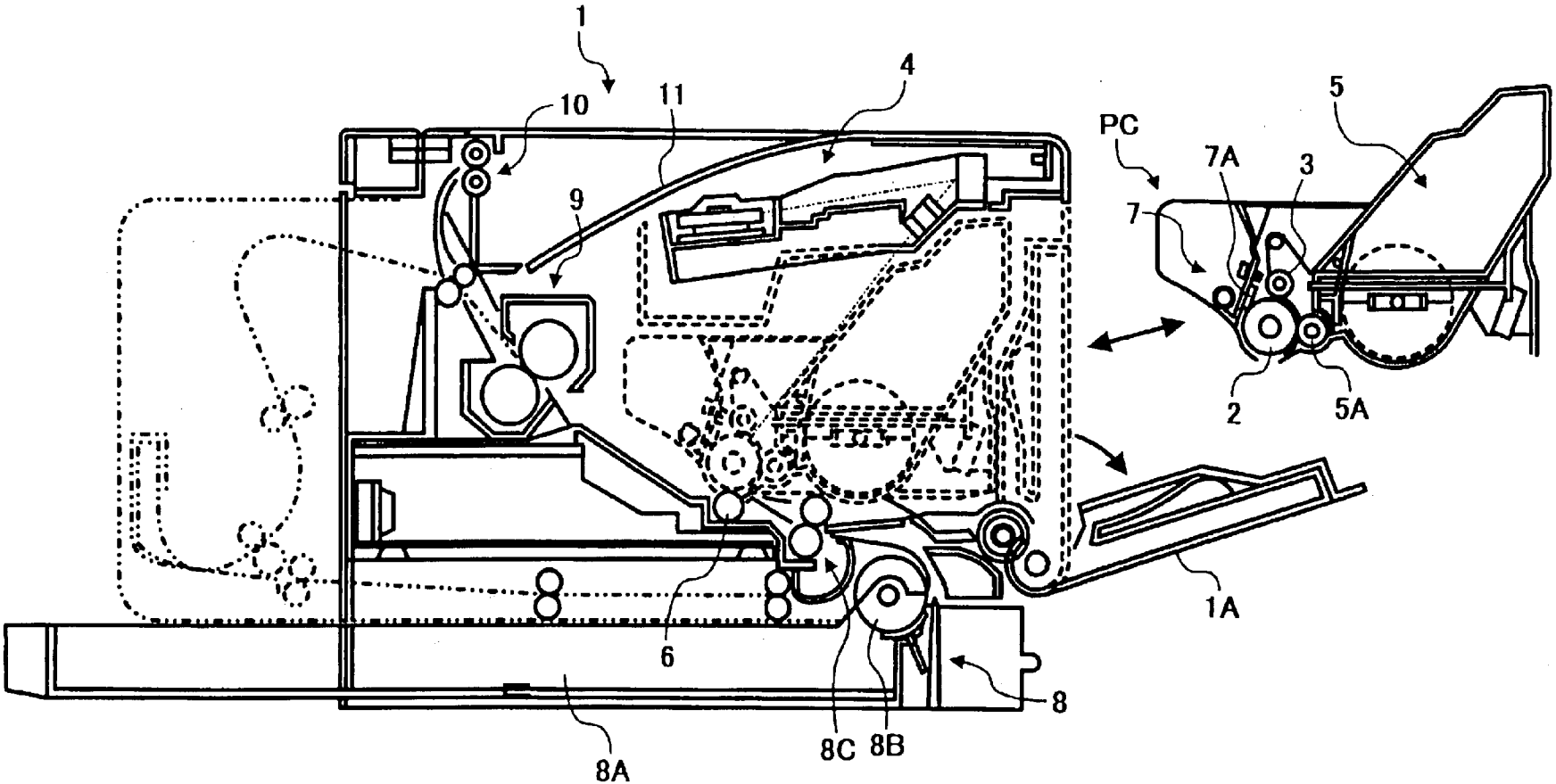
FIG. 2 demonstrates mounting and dismounting of a process cartridge from the apparatus of FIG. 1.

As shown in FIG. 2, part of the casing of the laser printer 1 is openable to admit the process cartridge PC into the casing. More specifically, when toner should be replenished to the developing unit 5 or when any one of the constituents of the process cartridge PC needs maintenance, the above part of the casing is opened to a position indicated by a solid line, and then the process cartridge PC is dismounted from the casing.

Figure 3:
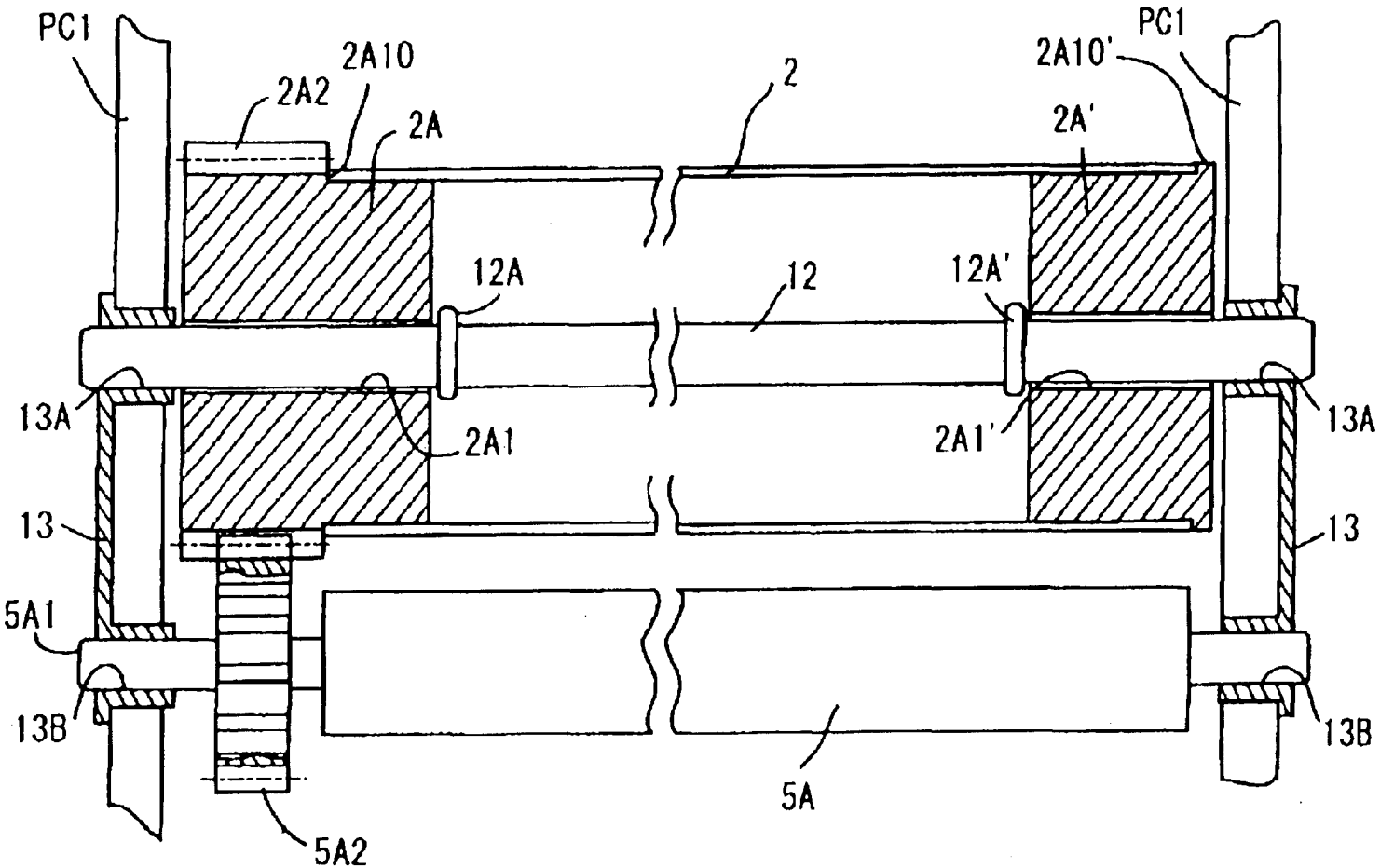
FIG. 3 is a section showing a rotary body support structure embodying the present invention.
Figure 4:
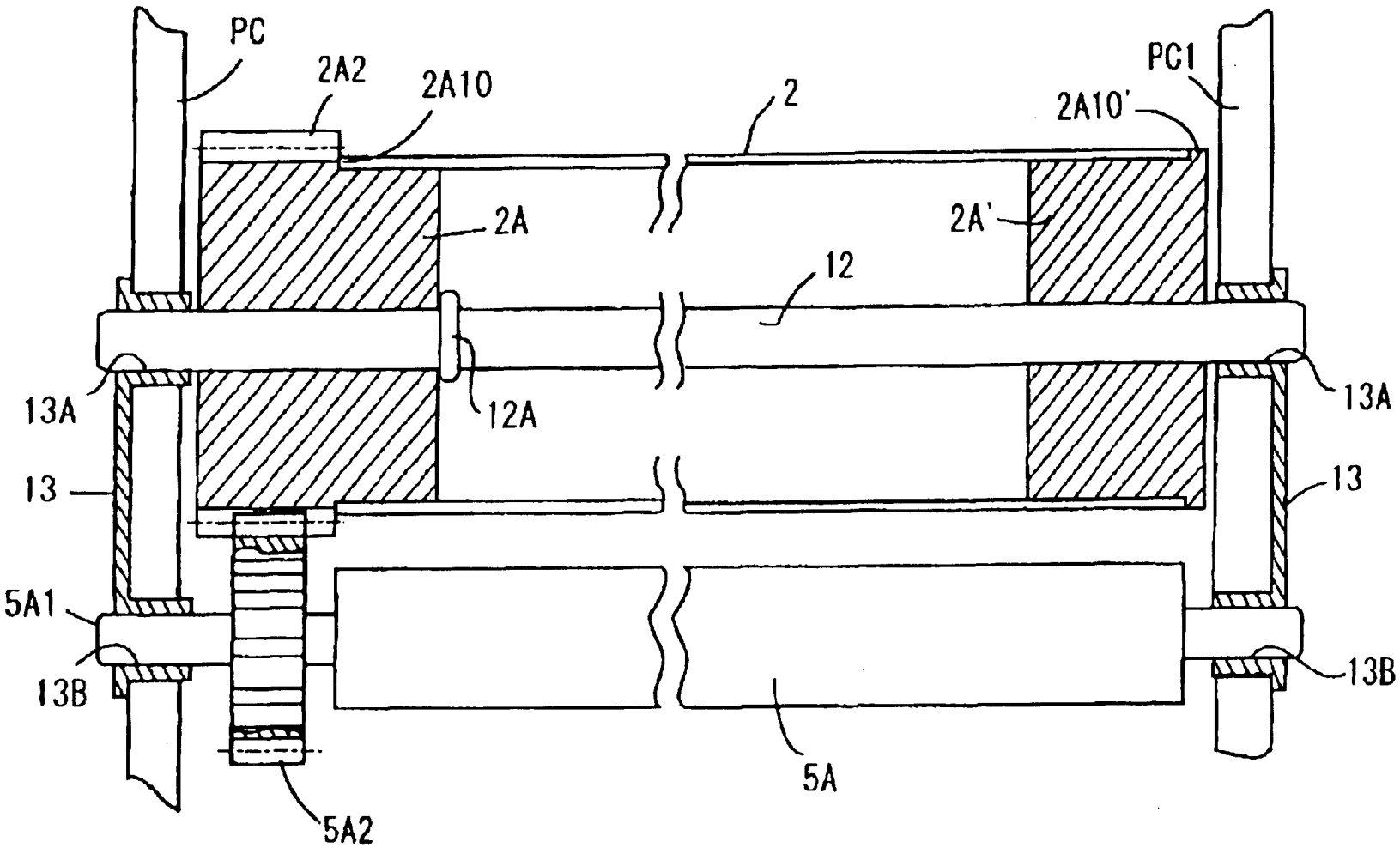
FIG. 4 is a section showing an alternative embodiment of the present invention.

FIGS. 3 and 4 each show a particular structure for supporting the drum 2, which is one of rotary bodies included in the process cartridge PC, embodying the present invention. In the illustrative embodiment shown in FIG. 3, the drum 2 is constructed integrally with a rotary shaft 12 beforehand. More specifically, end plates 2A and 2A' are press-fitted or otherwise fixedly fitted in axially opposite ends of the drum 2. Holes 2A1 and 2A1' are formed throughout the centers of the end plates 2A and 2A', respectively.

A gear portion 2A2 is formed on the outer periphery of the end plate 2A and serves as drive transmitting portion. The end plate 2A is fitted in the drum 2 before the other end plate 2A'. More specifically, after the shaft 12 has been inserted in the drum 2, the end plate 2A' is fitted in the drum 2. Flanges 12A and 12A' are formed on the shaft 12 inward of the end plates 2A and 2A', respectively, in the axial direction of the shaft 12. The flanges 12A and 12A' prevent the drum 2 from moving on the shaft 12 in the direction of thrust.

In the illustrative embodiment, to position the drum 2 relative to the sleeve 5A of the developing unit 5A facing the drum 2, the shaft 12 of the drum 2 and a rotary shaft 5A1, supporting the sleeve 5A, both are supported by positioning plates 13 at axially opposite ends thereof. Holes 13A and 13B are formed in each of the positioning plates 13 at preselected positions and assigned to the shafts 12 and 5A1, respectively. The shafts 12 and 5A1 are respectively inserted in the holes 13A and 13B and positioned thereby. The positioning plates 13 are affixed to opposite end walls PC1 of the process cartridge PC.

In assembly, after one end of the shaft 12 in the axial direction has been inserted in one end plate 2A, the other end plate 2A' is fitted in the drum 2. In this condition, the drum 2 is prevented from moving on the drum 2 in the direction of thrust by the flanges 12A and 12A'. Subsequently, the opposite ends of the shaft 12 are inserted in the holes 13A of the positioning plates 13, so that the drum assembly is mounted to the process cartridge PC.

Likewise, the opposite ends of the sleeve 5A of the developing unit 5 are inserted in the holes 13B of the positioning plates 13. Consequently, the drum 2 and sleeve 5A are positioned relative to each other while facing each other. This relative position is so set as to determine the height of a magnet brush, which the developer forms on the sleeve 5A, and to insure accurate meshing of the gear portion 2A2 of the drum 2 and a gear 5A2 included in the sleeve 5A.

In the configuration described above, the drum 2 is freely rotatable on the shaft 12 inserted in the end plates 2A and 2A'. Even in this configuration, the axis of the drum 2 is accurately positioned relative to the axis of the sleeve 5A because the shaft 12 is positioned relative to the shaft 5A1 by the positioning plates 13.

As for assembly, the drum 2 and shaft 12 are constructed integrally with each other beforehand and handled as a single body. Therefore, the shaft 12 can be mounted to the process cartridge PC only if the drum 2 is mounted to the process cartridge PC. This reduces or practically obviates the need for an extra space, compared to a case wherein the drum 2 is temporarily positioned in the process cartridge PC and then the shaft 12 is inserted.

FIG. 4 shows an alternative embodiment of the present invention. In FIG. 4, structural elements identical with those shown in FIG. 3 are designated by identical reference numerals and will not be described specifically in order to avoid redundancy. This embodiment differs from the previous embodiment in that the drum 2 and end plates 2A and 2A' are rigidly affixed to each other.

More specifically, in the illustrative embodiment, the holes 2A1 and 2A1' formed in the end plates 2A and 2A', respectively, are provided with an inside diameter that allows the shaft 12 to be push-fitted in the holes 2A1 and 2A1'. That is, the shaft 12 is press-fitted in the holes 2A1 and 2A1'. It is to be noted that legends 2A1 and 2A1' are not shown in FIG. 4 to clearly show the press-fitted condition. In this configuration, the drum 2 and shaft 12 are rigidly assembled together, so that the end plates 2A and 2A' are rotatable together with the shaft 12. In the illustrative embodiment, only one flange 12A is formed on the shaft 12 because of the press-fitting of the end plates 2A and 2A' and shaft 12.

In each of the embodiments shown in FIGS. 3 and 4, the end plates 2A and 2A' are respectively formed with large-diameter portions 2A10 and 2A10' that allow the ends of the drum 2 to abut thereagainst. Particularly, in the end plate 2A including the gear portion 2A2, the side wall of the gear portion 2A2 constitutes the large-diameter portion 2A10.

In the embodiment shown in FIG. 4, the end plates 2A and 2A' and shaft 12 are affixed to each other by press-fitting without any gap existing therebetween. The axis of the drum 2 can therefore be positioned without any play otherwise brought about by the above gap. Further, irregular rotation ascribable to play, which would lower rotation accuracy, is obviated.

The process cartridge PC described above is applicable not only to a single-color image forming apparatus but also to a full-color or similar multicolor image forming apparatus. In the case of a multicolor image forming apparatus, a plurality of process cartridges each are provided with the respective support structure of the present invention, so that the drums 2 of the process cartridges can be positioned relative to each other and allow images of different colors to be brought into accurate register.

In summary, in accordance with the present invention, a rotary body and a shaft thereof are constructed integrally with each other beforehand. Therefore, it is not necessary to position the rotary body or the shaft and then insert the shaft or the rotary body later, obviating the need for an extra space for insertion. Particularly, the rotary body and shaft are rigidly affixed to each other without any play and can therefore be accurately positioned. Further, the rotary body and a non-rotatable body are mounted on a process cartridge together. Therefore, despite that a space available in the process cartridge is limited, the rotary body can be mounted or dismounted without resorting to any extra space. This facilitates assembly and replacement.

Various modifications will become possible for those skilled in the art after receiving the teachings of the present invention without departing from the scope thereof.

What is claimed is:

1. A method of making an image forming apparatus comprising:

fitting a pair of end plates into axially opposite ends of a drum;

inserting a first shaft into apertures in said end plates;

inserting ends of said first shaft into first holes in a pair of positioning plates; and inserting ends of a second shaft into second holes in said pair of positioning plates to position said drum at a fixed distance from a developing roller on said second shaft.

2. The method recited in claim 1 further comprising:

forming at least one flange on said first shaft to restrict movement of one of said end plates.

3. The method recited in claim 1 wherein said inserting a first shaft into apertures in said end plates includes configuring said drum to rotate freely around said first shaft.

4. The method recited in claim 1 wherein said inserting a first shaft into apertures in said end plates includes fixing said first shaft to said end plates such that said first shaft and said drum are rotatable integrally.

5. An image forming apparatus comprising:

a photoconducting drum unit including;

a first shaft;

a pair of end plates, said first shaft fitted in apertures in said end plates; and a photoconducting drum, said end plates assembled integrally with said drum;

a developing unit including a developing roller on a second shaft; and a pair of positioning plates, said positioning plates including at least a first and a second hole, wherein ends of said first shaft are inserted in said first holes of said positioning plates and ends of said second shaft are inserted in said second holes of said positioning plates to position said developing roller and said photoconducting drum at a fixed relative distance.

6. The image forming apparatus recited in claim 5, further comprising:

at least one flange formed on said first shaft, said at least one flange configured to restrict movement of one of said end plates.

7. The image forming apparatus recited in claim 5, further comprising:

a first gear configured to mate with a driving gear to rotate said first shaft.

8. The image forming apparatus recited in claim 7, wherein said first gear is formed integrally with one of said end plates.

9. The image forming apparatus recited in claim 7, further comprising:

a second gear on said second shaft, said second gear configured to mate with said first gear, said second gear configured to rotate said second shaft.

10. The image forming apparatus recited in claim 5, wherein said drum is configured to be freely rotatable relative to said first shaft.

11. The image forming apparatus recited in claim 5, wherein said drum and said first shaft are configured to be rotatable integrally.

* * * * *